US009655422B2

(12) United States Patent
Buijssen

(10) Patent No.: US 9,655,422 B2
(45) Date of Patent: May 23, 2017

(54) HOLDER FOR CONSUMER PRODUCTS, FLAP PORTION FOR SUCH A HOLDER, AND COMBINATION OF SUCH A HOLDER AND A PANEL ELEMENT

(71) Applicant: VELCRY DESIGN, Boxtel (NL)

(72) Inventor: Marcus Henricus Nobertus Buijssen, Boxtel (NL)

(73) Assignee: VELCRY DESIGN, Boxtel (NL)

( * ) Notice: Subject to any disclaimer, the term of this patent is extended or adjusted under 35 U.S.C. 154(b) by 15 days.

(21) Appl. No.: 14/759,447

(22) PCT Filed: Jan. 7, 2014

(86) PCT No.: PCT/NL2014/050004

§ 371 (c)(1),
(2) Date: Jul. 7, 2015

(87) PCT Pub. No.: WO2014/109638

PCT Pub. Date: Jul. 17, 2014

(65) Prior Publication Data

US 2015/0351508 A1 Dec. 10, 2015

(30) Foreign Application Priority Data

Jan. 8, 2013 (NL) ..... 2010096

(51) Int. Cl.
*A45C 11/00* (2006.01)
*A45C 13/10* (2006.01)
(Continued)

(52) U.S. Cl.
CPC ..... *A45C 11/00* (2013.01); *A45C 13/005* (2013.01); *A45C 13/10* (2013.01); *A45F 5/00* (2013.01);
(Continued)

(58) Field of Classification Search
CPC ..... A45C 11/00; A45C 13/005; A45C 13/10; A45C 2011/002; A45C 2011/003; A45C 2200/15; A45F 5/00; G06F 1/1626
(Continued)

(56) References Cited

U.S. PATENT DOCUMENTS 7,389,872 B2 * 6/2008 Wheeler ..... G06F 1/1628 206/320
8,573,394 B2 * 11/2013 Ahee ..... G06F 1/1626 206/320
(Continued)

FOREIGN PATENT DOCUMENTS

EP 2 511 790 A2 10/2012
GB 2 377 366 A 1/2003

OTHER PUBLICATIONS

International Search Report issued by the European Patent Office dated Apr. 14, 2014 for International PCT Patent Application No. PCT/NL2014/050004.

*Primary Examiner* — Bryon Gehman
(74) *Attorney, Agent, or Firm* — Shumaker, Loop & Kendrick, LLP

(57) ABSTRACT

A holder for consumer products, including an at least substantially rectangular, flat storage portion having a first and a second at least substantially flat wall, the walls defining between them at least one flat compartment provided with an opening for accommodating the consumer products therein, and an at least substantially flat flap portion having an at least substantially rectangular plate-shaped wall element, wherein a first elongate connecting element is provided at the location of a first longitudinal edge of the wall element is designed for being accommodated in a first passage that is provided in the first wall for interconnecting the wall element and the storage portion.

13 Claims, 13 Drawing Sheets

(51) Int. Cl.
*A45F 5/00* (2006.01)
*A45C 13/00* (2006.01)

(52) U.S. Cl.
CPC ... *A45C 2011/002* (2013.01); *A45C 2011/003* (2013.01); *A45C 2200/15* (2013.01)

(58) Field of Classification Search
USPC ..... 206/45.24, 320; 220/843, 844, 848; 455/90.3, 575.3
See application file for complete search history.

(56) References Cited

U.S. PATENT DOCUMENTS

| | | | | |
|---|---|---|---|---|
| 8,833,555 | B2 * | 9/2014 | Bennett, Jr. ..... | A45C 11/00 206/320 |
| 2006/0081489 | A1 | 4/2006 | Wheeler et al. | |
| 2009/0039124 | A1 * | 2/2009 | Leto ..... | A45F 5/10 206/223 |

* cited by examiner

HOLDER FOR CONSUMER PRODUCTS, FLAP PORTION FOR SUCH A HOLDER, AND COMBINATION OF SUCH A HOLDER AND A PANEL ELEMENT

TECHNICAL FIELD AND BACKGROUND OF THE INVENTION

The present invention relates to a holder for suitably accommodating consumer products such as a portable computer, for example a tablet computer or a smartphone.

The present invention further relates to a flap portion for such a holder and to a combination of a holder and a panel element.

A known holder for accommodating consumer products is a so-called "bag" for a portable computer such as a tablet computer, or for stationery such as a writing pad. Said holder has a storage portion which comprises a compartment for accommodating a tablet computer, for example, and a flap portion which can be folded over at least an opening in the storage portion for covering the opening of the storage portion. The present invention in particular relates to such holders.

A drawback of the aforesaid known holder is the fact that personalising the holder is relatively laborious or unfavourable for cost reasons, in particular in the case of relatively small numbers.

BRIEF SUMMARY OF THE INVENTION

Accordingly it is an object of the present invention to make it easier to personalise such a holder. The present invention to that end provides a holder as defined in claim 1.

An advantage of the present invention is that because the flap portion, or at least a wall element thereof, and the storage portion are separately provided, these different parts are easier to personalise and at lower cost. The connecting method, in which use is made of the elongate connecting element, is a simple and robust method.

Preferably, the holder comprises a further flap portion, wherein the flap portion is provided between the storage portion and the further flap portion, wherein a second elongate connecting element is provided at the location of a second longitudinal edge of the wall element located opposite the first longitudinal edge, which second elongate connecting element is designed for being accommodated in a second passage provided at the location of a longitudinal edge of the further flap portion for interconnecting the wall element and the further flap portion. Such an embodiment of a holder comprising two flap portions is also called a "wrap".

It is advantageous if the holder comprises a strip-shaped element at the location of two opposite short edges of the wall element that extend transversely to the first longitudinal edge of said wall element, which strip-shaped element extends along the respective short edge and which is oriented perpendicularly to the plane of the wall element. Such a strip-shaped element increases the flexural stiffness of the flap portion and can furthermore function as a protection part or bumper for increasing the robustness of the holder.

In an advantageous embodiment, the respective strip-shaped element extends outside the wall element at the location of at least one of the first and the second longitudinal edge of the wall element, wherein the respective projecting parts of the strip-shaped element are designed for connecting a respective connecting element thereto. The strip-shaped elements may be separate from the wall element and be detachably or permanently connected thereto or form an integral part therewith.

In a simple embodiment, the projecting parts of the strip-shaped element are provided with a hole, which, in assembled condition, is in line with a recess that is axially provided in a connecting element, wherein a fastening element such as a screw can be inserted into the recess through the hole for interconnecting the connecting element and the strip-shaped element.

It is furthermore advantageous if at least the first elongate connecting element has an end part, at the location of the two free ends thereof, which is connected to an elongate central part of the connecting element via an intermediate part that is narrower than the end part, wherein each of the aforesaid projecting parts of the strip-shaped element has a chamber for holding the end part of the connecting element therein, which chamber can be reached via a passage through which the end part can pass, and wherein the chamber is larger than the passage to such an extent that the end part can be retained in the chamber, at least substantially in a form-locking manner, by being manipulated after being moved into the chamber via the passage.

The chamber may have a rear wall on a side remote from the passage. The end part is preferably rotationally symmetrical, but alternatively it may also be of oval or triangular cross-section, for example.

It is furthermore advantageous if the passage is provided with a recess, at a location along its circumference, which is adapted to the intermediate part of the connecting element, wherein the connecting element can be slid into the recess with its intermediate part after the end part has been moved into the chamber via the passage so as to thus retain the end part in the chamber in an at least substantially form-locking manner.

It is also advantageous in this regard if the recess is provided on a side of the circumference of the recess remote from the longitudinal edge of the wall element, wherein the holder comprises a blocking element which at least substantially fills a gap between the longitudinal edge and the central part of the connecting element, at least once the intermediate piece is present in the recess, such that the intermediate part is locked against movement from the recess back into the passage. The blocking element preferably has an elongate, strip-shaped configuration and comprises a flat, strip-shaped web portion which abuts against the wall element, at least in fitted condition.

It is furthermore advantageous if the strip-shaped element is provided with a slot in which the short edge of the wall element can be accommodated.

It is advantageous if the elongate connecting element extends along at least substantially the entire length of the longitudinal edge of the wall element.

Preferably, the wall element has a central through hole, which is enclosed by a frame-shaped edge portion. This saves weight and cost. In addition to that, this makes it possible to attach a panel element (yet to be described in more detail) to the wall element on the inner side of the holder, whilst the panel element is nevertheless visible from outside through the hole.

With a view to connecting a panel element to the wall element it is advantageous if one of a hook part or a loop part of a hook-loop connecting element is provided on at least one flat side of the wall element.

Preferably, at least the first wall of the storage portion comprises a flexible material, at least at the location of the aforesaid longitudinal edge thereof, wherein the passage in the first wall is formed by a folded-over portion of the first wall. This may for example be a hem in a wall consisting of canvas material. Alternatively, the passage may be formed by one hole or a number of aligned holes in the wall, through which the connecting element can be passed.

It is advantageous if the first and the second wall of the rectangular storage portion are interconnected along three of the four circumferential edges thereof, wherein the non-connected edges define the opening of the compartment and wherein the non-connected edge of the first wall forms the aforesaid longitudinal edge of the first wall for connection with the flap portion.

In one embodiment, the first elongate connecting element is connected to a further elongate connecting element via two respective coupling pieces at the two ends thereof, which further elongate connecting element is designed for being accommodated in a further passage that is provided in the longitudinal edge of the wall element of the flap portion for thus interconnecting the wall element and the storage portion via the first elongate connecting element. The coupling pieces are preferably strip-shaped, wherein the coupling piece is preferably connected to an end of an elongate connecting element in a manner analogous to the manner in which, as described above, the elongate connecting element is connected to the strip-shaped element, for example via a screwed connection or a form-locking connection, or through the use of a chamber provided with a passage in the strip-shaped element, as described above.

In one embodiment, the coupling pieces are straight, wherein preferably the spacing between the two elongate connecting elements is such that the wall material of the respective passages through which the aforesaid connecting elements extend is directly adjacent to each other. In an alternative embodiment, the coupling pieces are curved. The spacing between the elongate connecting element and the further elongate connecting element, viewed in a direction perpendicular to the longitudinal direction thereof, preferably corresponds approximately to a height of the storage portion, or, in other words, approximately to the spacing between the first and the second wall of the storage portion, to which optionally the thickness of the flap portion and optionally an additional spacing are added, so that more consumer products can be accommodated in the holder.

In a preferred embodiment, the aforesaid spacing amounts to about 125 percent of the aforesaid height of the storage portion.

In the case of such curved coupling pieces, the space between the two elongate connecting elements is preferably at least substantially filled by a wall element. An advantage of such a construction with a connecting element that is connected to the flap portion via coupling pieces and a further connecting element is that the flap portion can be connected to the storage portion in a very simple manner, whilst the flap portion, which may be made of cloth material with a hem edge in a simple embodiment, can be personalised in an efficient manner, for example by printing the cloth material.

It is furthermore advantageous in this regard if the flap portion, or at least the wall element thereof, is made of a flexible material, wherein the further passage is formed by a folded-over portion, or hem edge, of the flexible material.

The invention also relates to a combination of a holder as described above according to the invention and a flat panel element which is configured for being placed on the wall element and preferably covering the wall element at least substantially.

The invention also relates to a flap portion for use in a holder according to the invention, wherein the flap portion is at least substantially flat, being designed for closing the holder by being folded over, the flap portion comprising an at least substantially rectangular plate-shaped wall element, wherein a first elongate connecting element is provided at the location of a first longitudinal edge of the wall element, which connecting element is designed for being accommodated in a passage that is provided in the first wall at the location of a longitudinal edge of the first wall of the storage portion, for interconnecting the flap portion and the storage portion. Advantages of the combination and of the flap portion are analogous to the advantages as described above of the holder according to the invention.

BRIEF DESCRIPTION OF THE DRAWINGS

The present invention will now be explained in more detail by means of a description of an embodiment of a holder according to the present invention with reference to the following figures, in which.

DETAILED DESCRIPTION OF THE INVENTION

Figure 1:
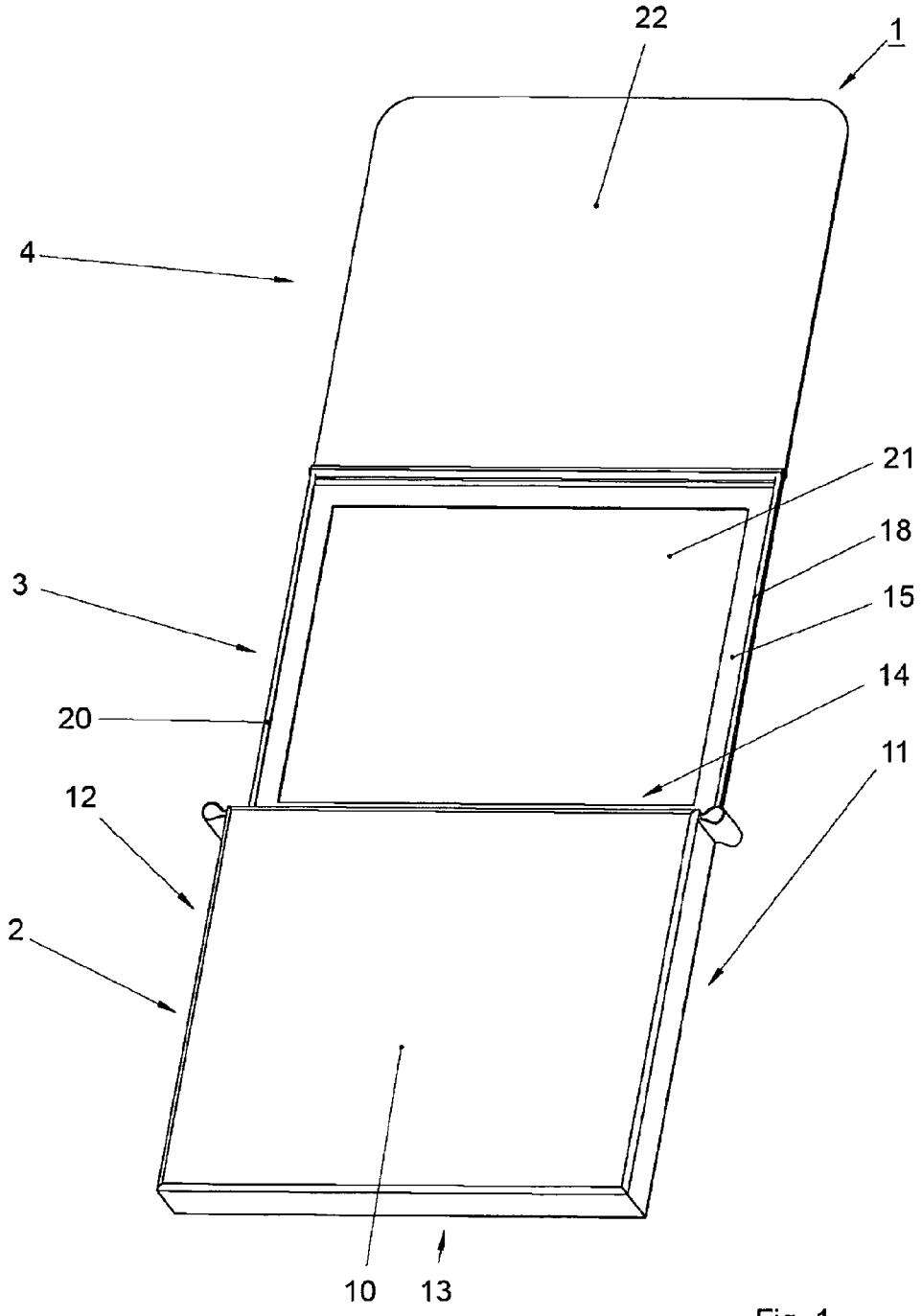
FIG. 1 is a three-dimensional view of a preferred embodiment of a front side of a holder according to the invention in unfolded condition.

The holder 1 shown in FIG. 1 is a bag, in particular for a notebook computer or a tablet computer, which bag is also referred to as "wrap". The holder 1 has a storage portion 2, a flap portion 3 and a further flap portion 4. The storage portion 2 consists substantially of a front wall 10 and a rear wall 24 (shown in FIG. 6, not shown in FIG. 1) which is located under the front wall 10. The front and the rear wall define a compartment present therebetween, in which a notebook computer and/or stationary, for example, or the like can be accommodated. The front and the rear wall are rectangular in shape, they are connected along three edges, optionally via an intermediate piece, for increasing the height of the compartment, viewed in a direction transversely to the front and rear wall. The aforesaid edges are the side edges 11 and 12 and the bottom edge 13. The fourth edge 14 of the front wall 10 is free, i.e. it is not connected to the rear wall 24. In this way an opening of the compartment is defined. Means such as straps or compartments may be provided on the front wall 10 for holding further consumer products such as stationary. At a longitudinal edge of the rear wall 24, which extends parallel to the front wall 10 at the location of the free edge thereof, the rear wall 24 is connected to the flap portion 3, optionally via a further intermediate piece comparable to the aforesaid connecting pieces at the location of the side edges 11, 12 and the bottom edge 13. The aforesaid intermediate pieces may also be integral with a wall. The material of the front wall 10 and the rear wall 24 is neoprene, but alternatively it may also be PVC canvas, for example, or tarpaulin (German: "LKW Plane") or leather or another cloth material. Optionally, the bag may be subdivided into sub-compartments by means of partitions.

The flap portion 3 is essentially made up of a wall element 15. The flap portion 3 is partially shown in FIG. 2. Besides the wall element 15, the flap portion 3 further comprises a first elongate connecting element in the form of a first rod 16, a second elongate connecting element in the form of a second rod 17 and two strip-shaped elements 18 and 20. The wall element 15 has a rectangular central recess 21, so that the wall element 15 actually forms a frame. The recess 21 is not essential. The wall element 15 may be made of a metal, such as aluminium, for example by means of a water jet cutting technique. Alternatively, the wall element 15 may be made of a plastic material. The rods 16 and 17 are provided at longitudinal edges of the wall element 15. In one embodiment, the aforesaid longitudinal edges may be formed by stiffening strips provided perpendicularly to the plane of the wall element 15. At the location of short edges of the wall element 15, strip shaped elements in the form of strips 18 and 20 are provided, which are preferably made of a plastic, such as nylon, or of a combination of plastic and rubber, for example. The strips 18 and 20 are disposed transversely to the plane of the wall element 15, see in particular FIG. 4. This increases the flexural stiffness of the flap portion 3. At the free ends of the strips 18, 20, which extend to beyond the longitudinal edges of the wall element 15, the rods 16, 17 are connected thereto via a screwed connection with screws 19. The strips 18, 20 may comprise a slot in the side facing the wall element 15, in which slot the short edges of the wall element 15 fit. The short edges of the wall element 15 may be provided with projections extending perpendicularly to the plane of the wall element 15, which projections will hook or snap in position in the slot wall upon being inserted into the slot for thus securing the wall element 15 in the slot. Optionally, the strips 18, 20 may be permanently connected to the wall element, for example by means of a glued joint. According to another alternative, the wall element 15 and the strips 18, 20 form one integral, for example injection-moulded part of plastic material.

The wall element 15 may be built up of several layers, for example a non-transparent inner layer, which abuts against the front wall 10 of the storage portion 2 in the folded condition of the flap portion 3, and a transparent outer layer. If desired, a panel element in the form of an image layer may be placed between the aforesaid layers. Said image layer can be placed by making at least one of the inner layer and the outer layer detachable, for example, or by providing one of the strip-shaped elements 18 or 20 with a slot-shaped passage for sliding the image layer therethrough to a position between the aforesaid inner and outer layer.

To realise the connection between the wall element 15 and the storage portion 2, the rear wall 24 of the storage portion 2 has a folded-over portion, or hem, at the location of the aforesaid longitudinal edge thereof, so that a passage is formed. Through said passage, a rod, such as the rod 16, can be passed, whereupon the rod 16 can be connected to the wall element 15, for example by means of the aforesaid screwed connection and via the strips 18, 20. Analogous thereto, the further flap portion 4 also has such a folded-over edge or hem, into which a rod, such as the rod 17, can be inserted. Thus a robust connection is formed, via the rods 16 and 17, between the wall element 15 on the one hand and both the storage portion 2 and the further flap portion 4 on the other hand.

In one embodiment of the flap portion, the flap portion is formed by the aforesaid assembly of wall element, strips and rods. Alternatively, the flap portion may comprise further material strips, which extend from the storage portion, along the strips, i.e. around the assembly, up to a further flap portion, for example. Said material strips thus form a connection between the storage portion and the further flap portion. The wall element can be connected therebetween, using the aforesaid rods.

Figure 2:
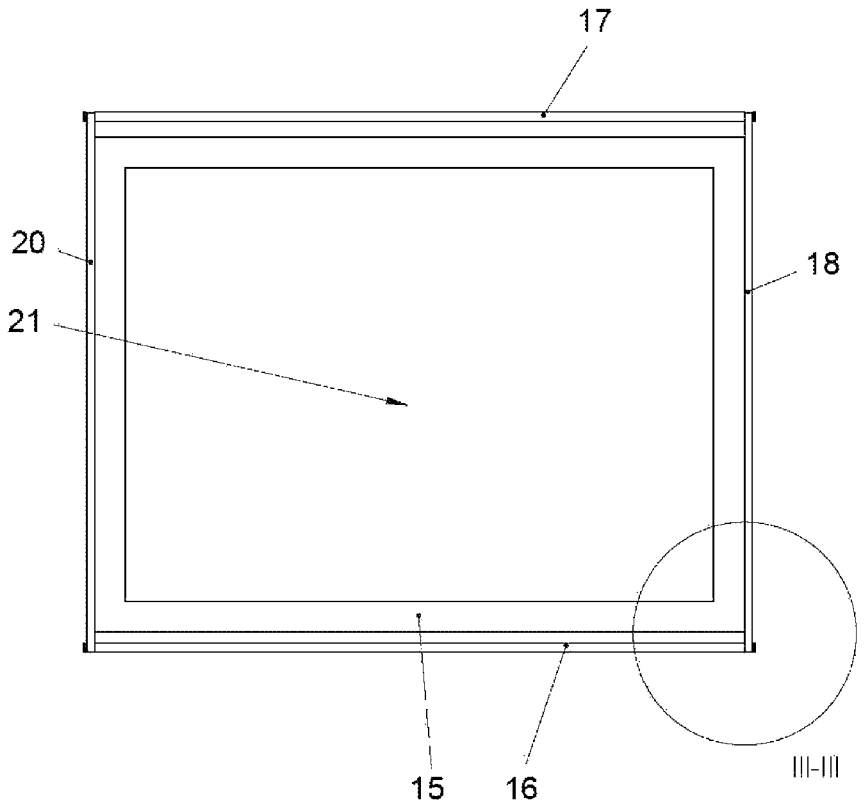
FIG. 2 shows a part of a flap portion for a holder according to FIG. 1.
Figure 3:
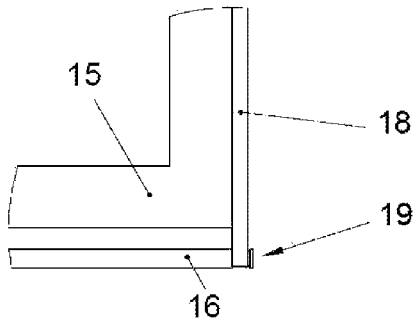
FIG. 3 shows the detail III-III of FIG. 2.
Figure 4:
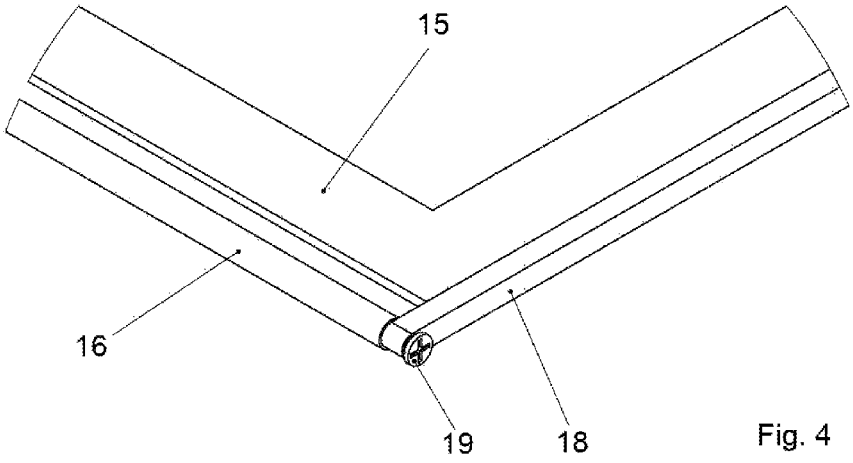
FIG. 4 shows the detail III-III in perspective view.
Figure 5:
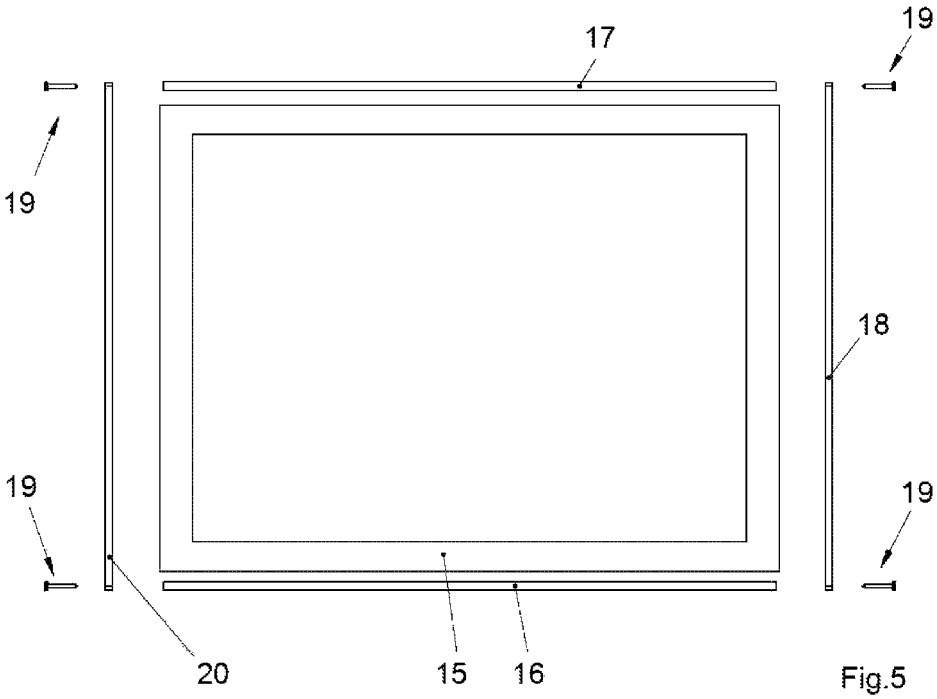
FIG. 5 is an exploded view of the flap portion of the holder of FIG. 1.
Figure 6:
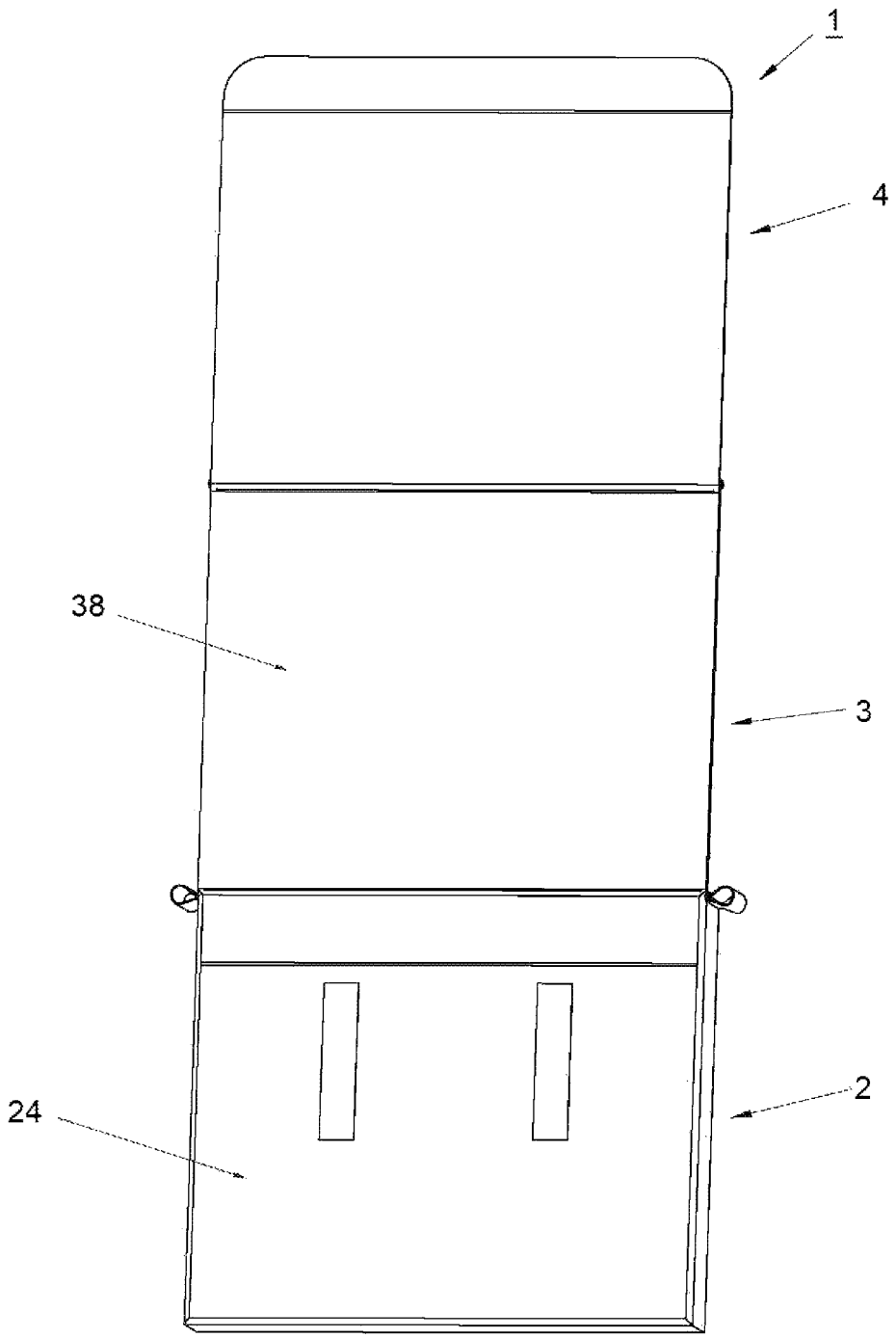
FIG. 6 is a rear view of the holder of FIG. 1 in unfolded condition, in combination with a panel element.
Figure 7:
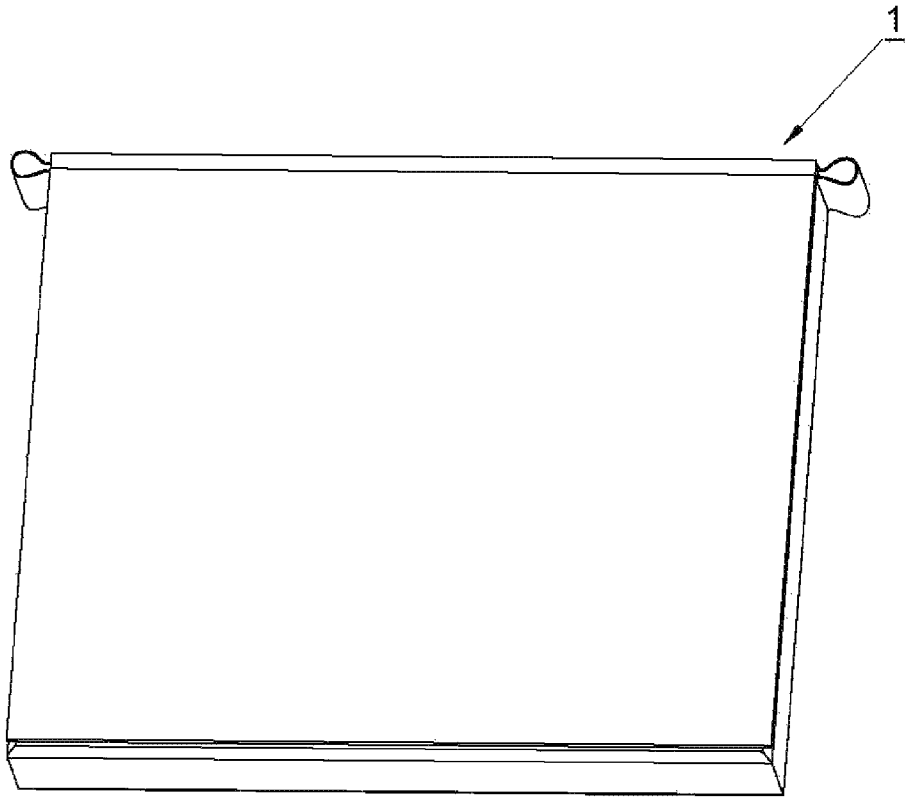
FIG. 7 shows the holder of FIG. 6 in closed condition.

The wall element is provided on at least one flat side with one of a hook part and a loop part of a hook-loop connecting element (shown in FIG. 5, not shown in FIGS. 2-4). A panel element can be connected to the wall element, for example a photo printed on cloth or canvas, as shown in FIGS. 6 and 7 (not shown in FIG. 1). At the rear side of the panel element, the other of the hook part and the loop part is provided for realising the connection with the wall part 15. The strips 18, 20, which project above the flat side of the wall element 15, thus also form a protection of the panel element. FIG. 6 shows the rear side of the holder, i.e. a rear wall of the storage portion 2, the flap portion 3 and the further flap portion 4. FIG. 7 shows the holder in closed condition, in which the inner wall 22 of the flap portion 4 abuts against the rear wall 24 of the storage portion 2.

Figure 10:
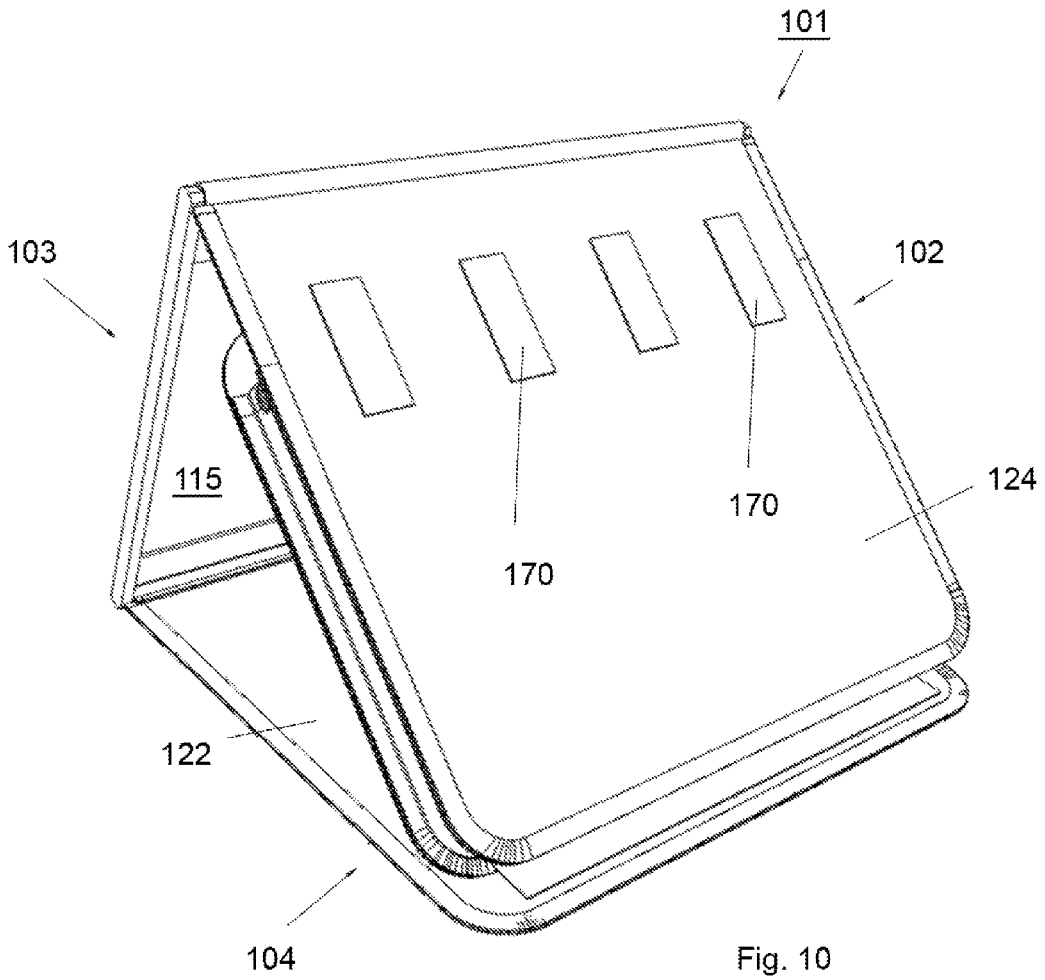
FIG. 10 shows the holder of FIG. 8 placed in a triangular shape.

The holder can be placed in a triangular shape, analogous to the triangular shape shown in FIG. 10, in which a free longitudinal edge of the further flap portion 4 will abut against the bottom edge 13. Optionally, connecting means may moreover be provided for interconnecting said edges. In the triangular shape, the holder can advantageously function as a support, for example for a tablet computer.

If desired, the holder can be hung on a wall by the flap portion or the further flap portion, in which case the panel element may be made up of a mirror, for example. In said compartment, case toiletries may for example be placed.

Figure 8:
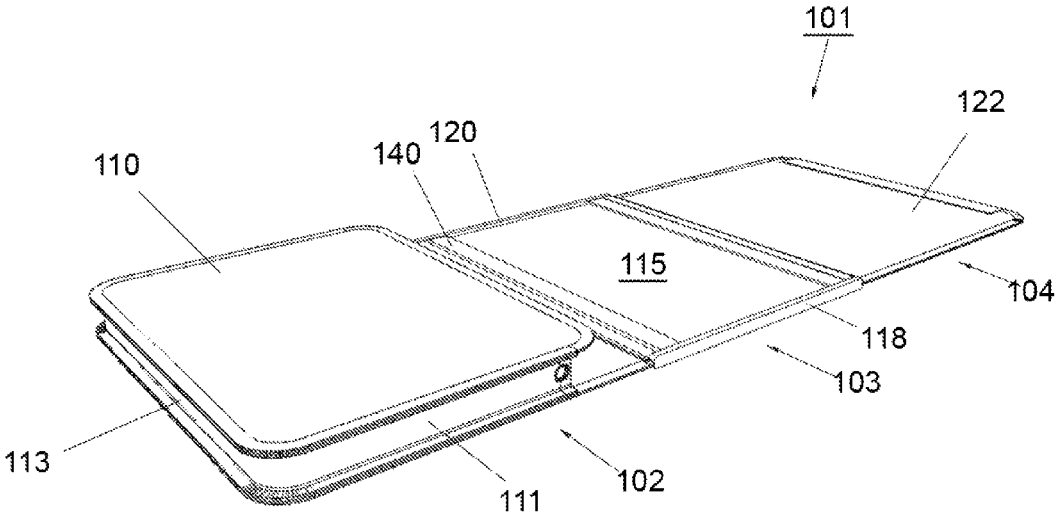
FIG. 8 is a three-dimensional view of another preferred embodiment of a holder according to the invention.
Figure 9:
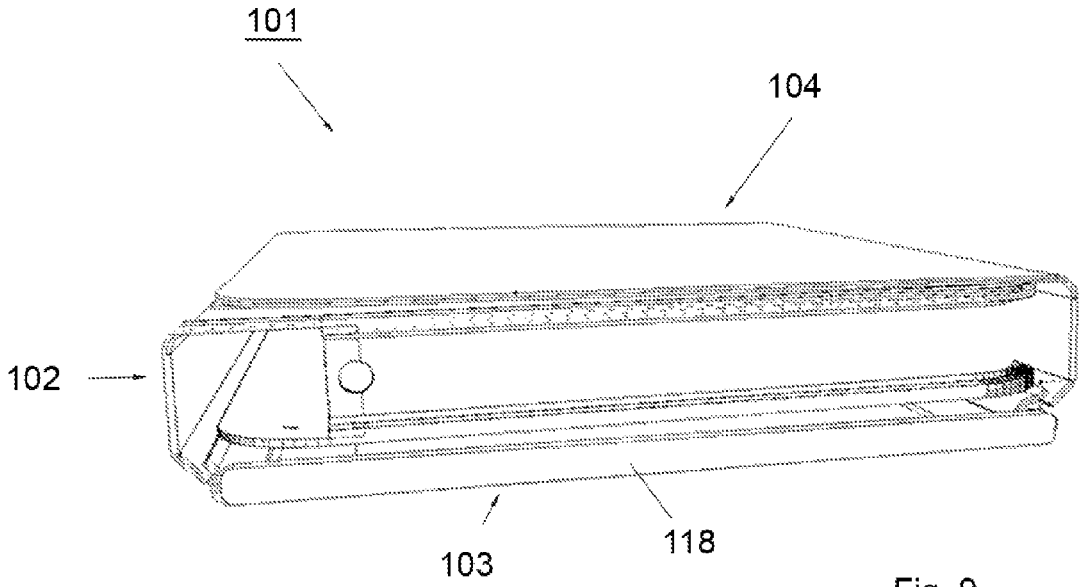
FIG. 9 is a side view of the holder of FIG. 8 in closed condition.
Figure 11:
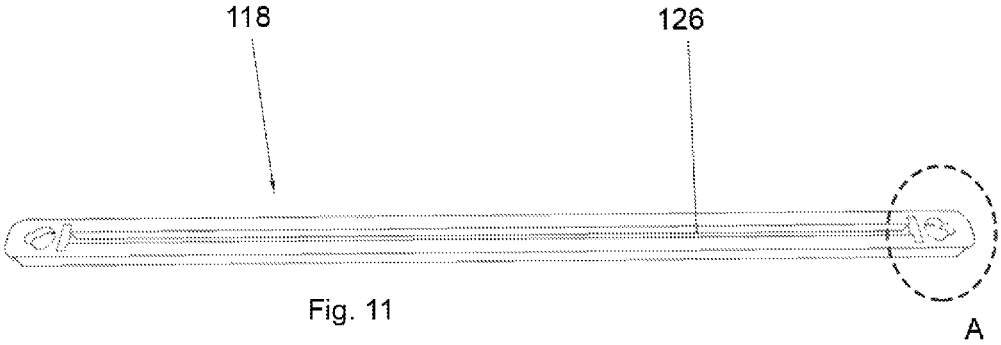
FIG. 11 is a three-dimensional view of a part of the holder of FIG. 8.
Figure 12:
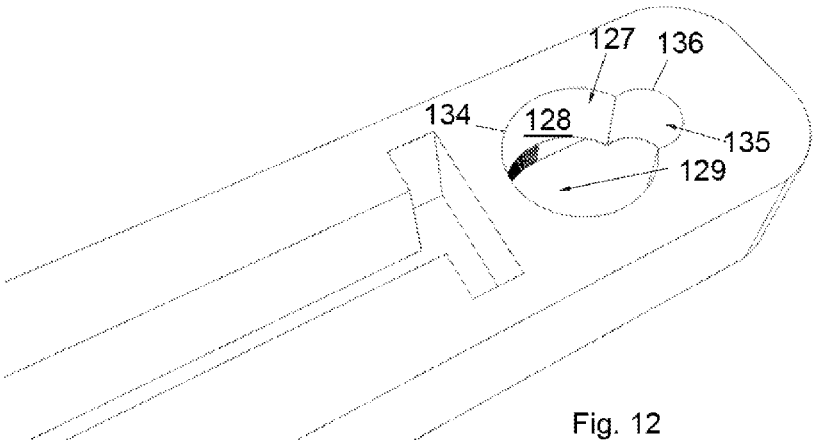
FIG. 12 is a three-dimensional view of detail A of FIG. 11.

In FIGS. 8-13 a holder 101 is shown, being a further preferred embodiment of a holder according to the invention. Like the holder 1, the holder 101 has a storage portion 102, a flap portion 103 with a wall element 115, and a further flap portion 104. The holder 101 shown in FIG. 8 is shown in closed condition in FIG. 9. In FIG. 10, the holder 101 is furthermore placed in a triangular shape so as to thus form a support, for example for a tablet computer. Friction-increasing elements 170 may be provided on the rear wall 124 of the storage portion 102 for largely preventing the aforesaid tablet computer, for example, or a holder such as a shell-shaped cover, sliding off the holder in the triangular shape thereof. In FIG. 11 a strip-shaped element 118 of the preferred embodiment of FIG. 8 is shown, which strip-shaped element is essentially the same as the strip-shaped element 18 of the holder 1. The strip-shaped element 118 is formed as an integral part, for example by means of an injection-moulding technique, but alternatively it may be 3D-printed or milled, for example. The strip-shaped element 118 comprises a slot 126 in which a short edge of the wall element 115 is present. The strip-shaped element 118 is provided with a passage 127 enclosed by the wall 128 for realising a connection with a rod 117 as shown in FIGS. 13*a* and 13*b*, which rod forms a connection between the flap portion 103 and the further flap portion 104. Said passage 127 enclosed by the wall 128 provides access to the chamber 129 in the strip-shaped element 118, which chamber 129 is larger than the passage 127. The passage 127 enclosed by the wall 128 is provided with a recess 135 at a position along the circumference, which recess is circular in shape and which partially overlaps the shape of the likewise circular passage 127, more specifically slightly less than half the circular shape of the recess 135. The diameter of the passage 127 is adapted to allow the passage of the end part 132 into the chamber 129 therethrough.

The recess 135 has a diameter which substantially corresponds to the external diameter of the intermediate part 130, with the wall of the recess 135 passing through at least half of a complete circumference for thus holding the intermediate part 130 in position to a certain extent, wherein the material of the element 118 is slightly deformable, so that the intermediate part 130 can pass from the passage 130 into the recess 135. With this embodiment of the strip-shaped element 118 and the rod 117, a form-locking connection can be obtained without additional connecting means such as screws being required. The same goes as regards connecting a rod 116 that forms the connection between the storage portion 102 and the flap portion 103.

In one embodiment (not shown) of a strip-shaped element comparable to the strip shaped element 118, the chamber is formed so that the end part of said element can be retained in the chamber in a form-locking manner. This form-locking connection can be achieved, for example, in that a passage via which the chamber is accessible is not rotationally symmetrical. The end part 132 will in that case have a non-rotationally symmetrical shape, viewed in the longitudinal direction of the rod 116. As a result, the end part can be rotated in such a manner after being inserted into the chamber that it cannot pass back via the passage. In this way the form-locking (at least to a certain extent) connection can be realised.

Figure 13A:
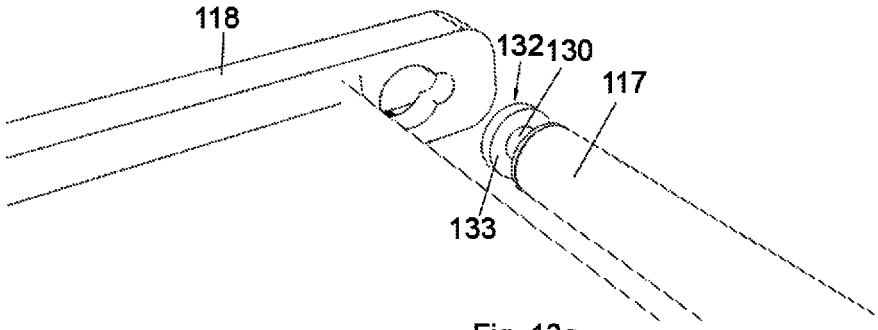
FIGS. 13 *a-f* are three-dimensional views of an assembly of various parts of the holder of FIG. 8 in different positions.
Figure 13B:
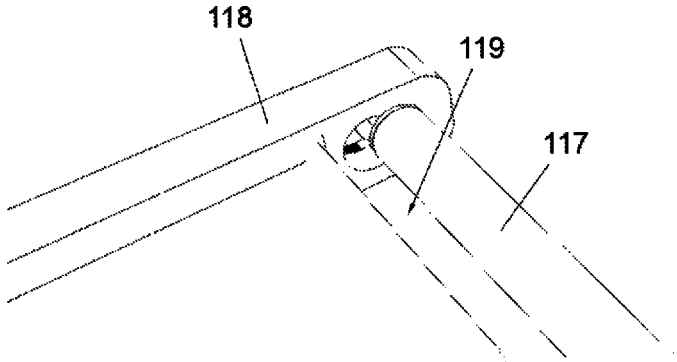
Figure 13C:
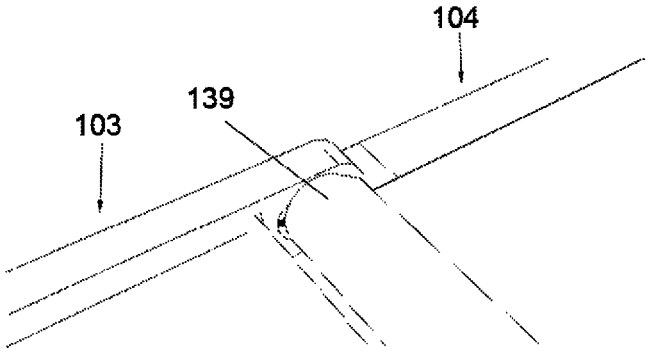

In FIG. 13*c* the flap portion 103, more specifically the wall part 115 thereof, is connected to the further flap portion 104 via the rod 117 (not shown in this figure), in that it extends through a hem 139 in the further flap portion 104. The same goes for the connection between the flap portion 103 and the storage portion 102, in that the rod 116 extends through a hem in the storage portion 2.

Figure 13D:
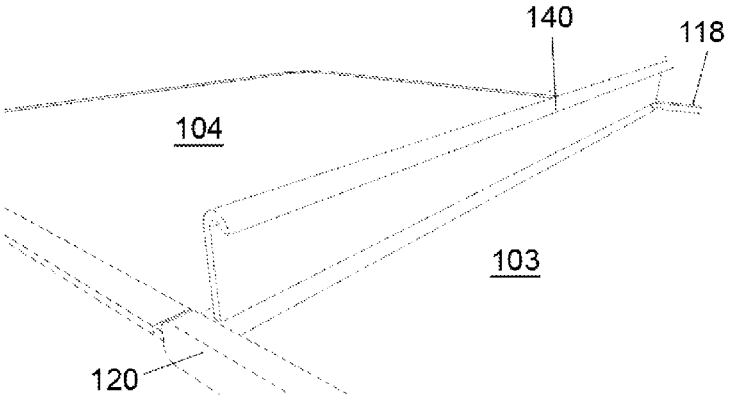
Figure 13E:
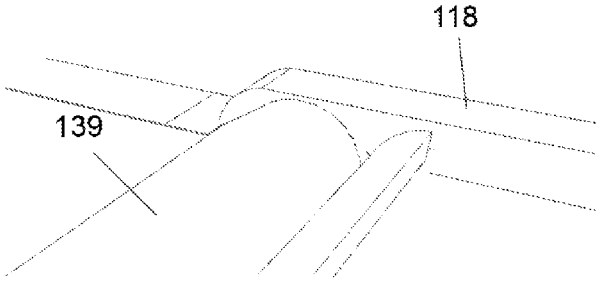
Figure 13F:
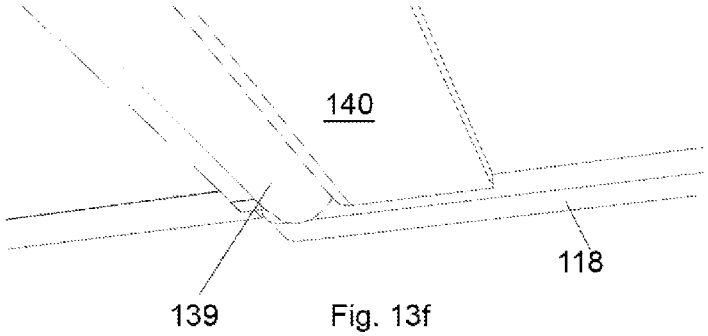

In order to largely prevent the rod 117 from getting out of the associated chamber 129 in use as a result of the rod 117 moving out of the recess 135, back into the passage 127, with its intermediate part 130, a blocking element 140 is provided, as shown in FIGS. 13*d-f*. The same goes for the connection by means of the rod 116, at the location of which a blocking element 140 is likewise provided. The blocking element 140 is an elongate strip with a curled longitudinal edge. As shown in FIGS. 13*d* and 13*e*, this strip can be passed through the gap 119 between the rod 117, around which the hem 139 of the further flap portion 104 extends, and the associated longitudinal edge of the wall element 115 of the flap portion 103, and be placed against the wall element of the flap portion 103 with its flat, strip-shaped web portion, and be attached thereto, for example using a hook-loop connection. By filling the aforesaid gaps with elements 140 it is ensured that the rods 116 and 117 will remain in their position, so that the form-locking position of the end parts thereof in the associated chambers of the strip-shaped elements 118 and 120 is maintained. In addition, the blocking elements 140 impart additional stiffness to the wall element 115 of the flap portion 103.

For personalisation of the holder 101, a panel element such as an image can be attached to the wall element 115 of the flap portion 103. An example of such a panel element is a cloth or tarpaulin provided with a print. Attachment to the wall element 115 can effectively be realised via a hook-loop connection.

Figure 14A:
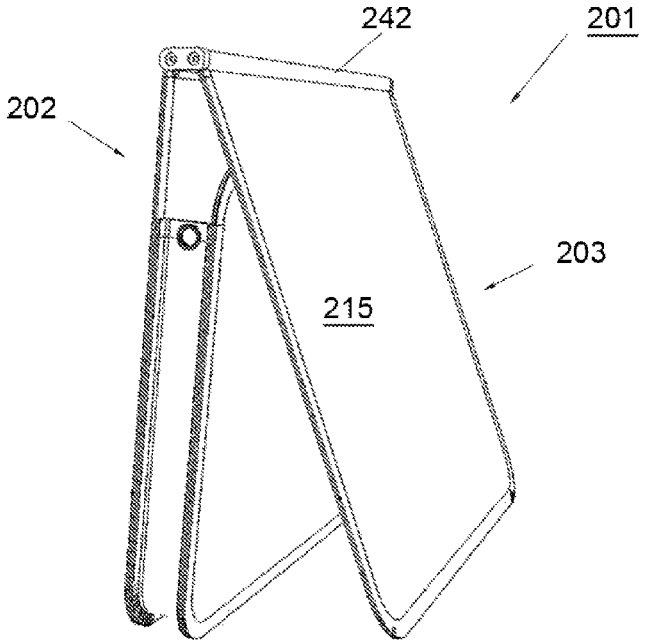
FIG. 14*a* is a three-dimensional view of yet another preferred embodiment of a holder according to the invention.
Figure 14B:
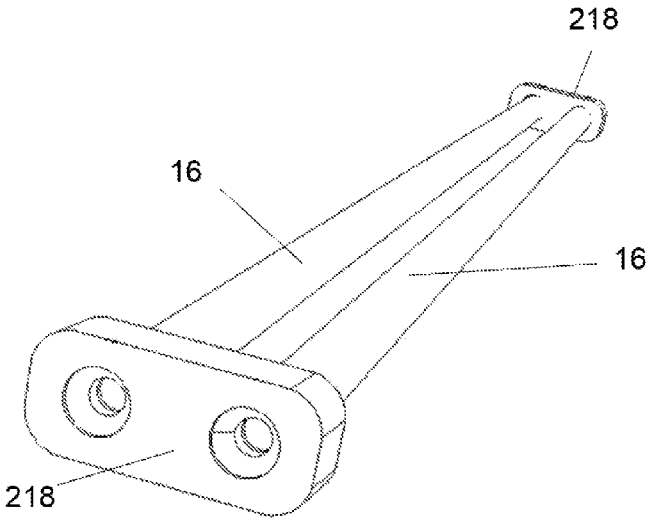
FIG. 14*b* shows a part of the holder of FIG. 14*a*.

In a holder 201 shown in FIGS. 14*a-b*, being another embodiment of a holder according to the invention, the holder 201 comprises a storage portion 202 and a flap portion 203. Both the storage portion 202 and the flap portion 203 comprise passages provided by hem edges 242 of the portions 202, 203 in question. At the location of a longitudinal edge of the wall element 215 located on the side of the storage portion 222, the flap portion 203 has an elongate connecting element in the form of a rod 16. Said rod 16 is connected to the flap portion 203 via an adjacent further rod 16 that extends through a hem 242 in the flap portion 203.

The storage portion 202 and the flap portion 203 are connected together by connecting the ends of the rod 16 to strip-shaped coupling pieces 218, see FIG. 14*b*, with the rod 16, which does not extend through the hem edge of the flap portion 203, extending through the hem edge of the storage portion 202. The rods 16 can be connected to the coupling pieces 218 by means of a screwed connection so as to obtain a connection between the storage portion 202 and the wall element 215 of the flap portion 203, comparable to the connection between the strip-shaped element 18 and the rod 16 of the holder 1. Alternatively, it is possible to realise a form-locking connection of the rods and the coupling pieces analogous to the previously described form-locking connection realised by using the strip-shaped element 118 in combination with the rod 116.

Figure 15:
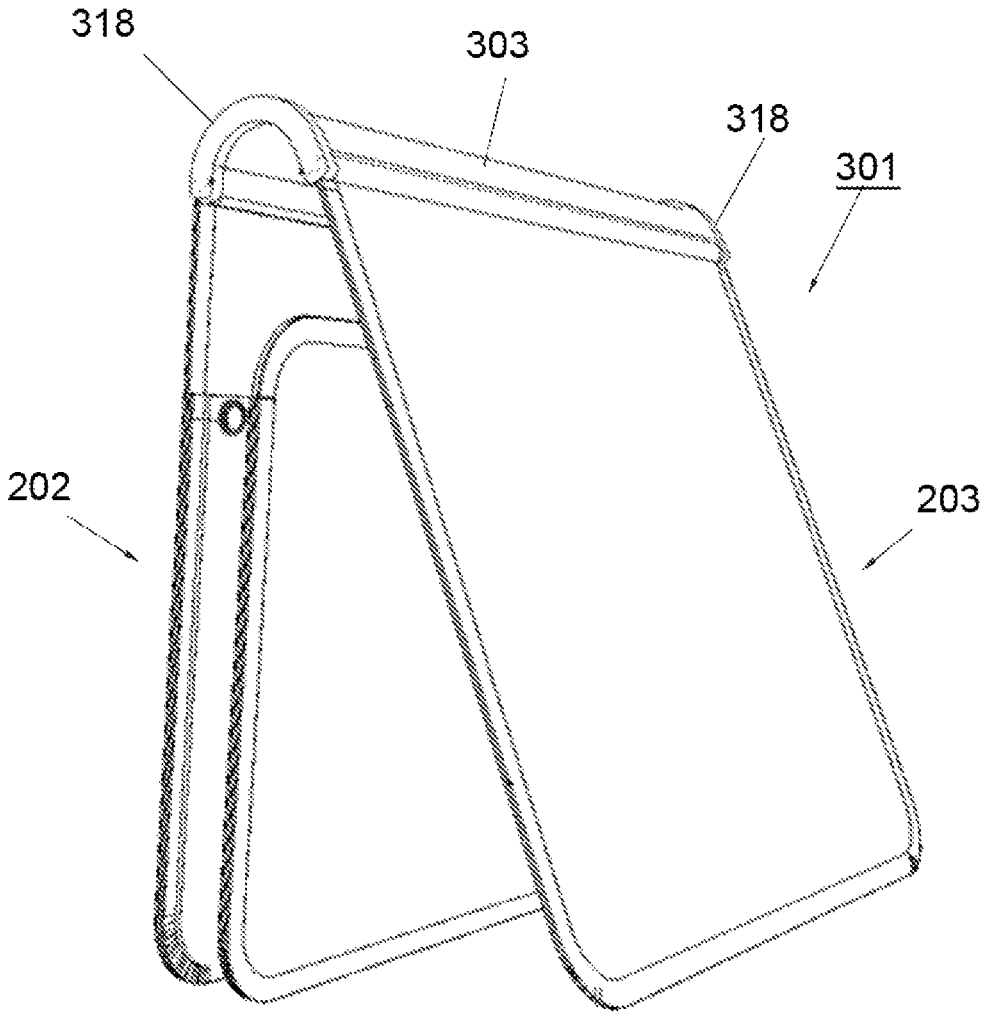
FIG. 15 is a three-dimensional view of yet another preferred embodiment of a holder according to the invention.

The holder 301 shown in FIG. 15 is a variant of the holder 201 shown in FIG. 14, with like parts being indicated by like numerals. In this embodiment, a storage portion 202 is connected to a flap portion 203. To realise this connection, rods are provided both in a passage in the flap portion 203 and in a passage in the storage portion 202, analogous to the rods 116 shown in FIG. 14*b*. The storage portion 202 and the flap portion 203 are connected in that a rod associated with the flap portion 203 extends through the passage in the storage portion 202. The ends of the rods 116 are connected to coupling pieces 318 as described above. The coupling pieces 318 comprise a slot in which a wall element 303 can be placed for thus bridging the space between the two rods.

The flap portion 203 has a wall element that is configured as a shaped part, for example of plastic material, but also as a flexible part made of canvas or cloth. The coupling pieces 318 are partially circular in shape, with the diameter of the circle substantially corresponding to the thickness of the holder 301 in the closed condition. Another shape of the coupling pieces 318, for example an angular shape, is also possible. It is furthermore possible to connect the rods to the coupling pieces in the above-describe manner, using a screwed connection, for obtaining a connection between the storage portion 202 and the flap portion 203.

The invention claimed is:

1. A holder for accommodating a consumer electronic device, comprising a rectangular, flat storage portion comprising first and second flat walls, the first and second flat walls defining between them at least one flat compartment provided with an opening for accommodating the consumer electronic device therein, and a flat flap portion configured to close the holder, the flat flap portion comprising a rectangular plate-shaped wall element, wherein a first elongate connecting element is provided at a location of a first longitudinal edge of the wall element, the connecting element accommodated in a first passage provided in the first flat wall at the location of a longitudinal edge of the first flat wall of the storage portion, for interconnecting the wall element and the storage portion, and further comprising, at a location of two opposite short edges of the wall element that extend transversely to the first longitudinal edge of the wall element, a strip-shaped element that extends along a respective one of the short edges and which is oriented perpendicular to a plane of the wall element.

2. The holder according to claim 1, comprising a further flap portion, wherein the flap portion is provided between the storage portion and the further flap portion, wherein a second elongate connecting element is provided at the location of a second longitudinal edge of the wall element located opposite the first longitudinal edge, the second elongate connecting element accommodated in a second passage provided in the further flap portion at the location of a longitudinal edge of the further flap portion for interconnecting the wall element and the further flap portion.

3. The holder according to claim 1, wherein the respective strip-shaped element extends outside the wall element at the location of the first longitudinal edge of the wall element, wherein respective projecting parts of the strip-shaped element connect the connecting element thereto.

4. The holder according to claim 3, wherein the projecting parts of the strip-shaped element are provided with a hole, which, in an assembled condition, is in line with a recess that is axially provided in a connecting element, wherein a fastening element is inserted into the recess through the hole for interconnecting the connecting element and the strip-shaped element.

5. The holder according to claim 3, wherein at least the first elongate connecting element has an end part, at the location of the two free ends thereof, which is connected to an elongate central part of the connecting element via an intermediate part that is narrower than the end part, wherein each of the aforesaid projecting parts of the strip-shaped element has a chamber for holding the end part of the connecting element therein, wherein the chamber can be reached via a passage through which the end part can pass, and wherein the chamber is larger than the passage to such an extent that the end part is retained in the chamber by being manipulated after being moved into the chamber via the passage.

6. The holder according to claim 5, wherein the passage is provided with a recess, at a location along its circumference, corresponding to the intermediate part of the connecting element, wherein the connecting element is slid into the recess with its intermediate part after the end part has been moved into the chamber via the passage so as to thus retain the end part in the chamber.

7. The holder according to claim 6, wherein the recess is provided on a side of the circumference of the recess remote from the longitudinal edge of the wall element, wherein the holder comprises a blocking element which fills a gap between the longitudinal edge and the central part of the connecting element, once the intermediate piece is present in the recess, such that the intermediate part is locked against movement from the recess back into the passage.

8. The holder according to claim 1, wherein the strip-shaped element is provided with a slot in which the short edge of the wall element is accommodated.

9. The holder according to claim 1, wherein the wall element has a central through hole enclosed by a frame-shaped edge portion.

10. The holder according to claim 1, wherein one of a hook part or a loop part of a hook-loop connecting element is provided on at least one flat side of the wall element.

11. The holder according to claim 1, wherein at least the first wall of the storage portion comprises a flexible material, at least at the location of the longitudinal edge thereof, wherein the passage in the first wall is formed by a fold of the first wall.

12. The holder according to claim 1, wherein the first and second flat walls of the rectangular storage portion are interconnected along three of four circumferential edges thereof, wherein non-connected edges define the opening of the compartment, and wherein a non-connected edge of the first wall forms the longitudinal edge of the first wall for connection with the flap portion.

13. A combination of a holder according to claim 1 and a flat panel element configured for being placed on the wall element to cover the wall element.

* * * * *